US005507440A

United States Patent [19]

Earle

[11] Patent Number: 5,507,440

[45] Date of Patent: Apr. 16, 1996

[54] MIXING METHOD FOR MATERIAL ONE OF WHICH IS IN PACKAGED FORM

[75] Inventor: Anthony Earle, Harrow Weald, England

[73] Assignee: Eastman Kodak Company, Rochester, N.Y.

[21] Appl. No.: 245,095

[22] Filed: May 17, 1994

[30] Foreign Application Priority Data

May 19, 1993 [GB] United Kingdom ..... 9310330

[51] Int. Cl.[6] ..... B02C 18/06; B02C 23/10

[52] U.S. Cl. ..... 241/14; 241/20; 241/24.12; 366/156.1

[58] Field of Search ..... 241/20, 21, 24, 241/25, 101.8, 14, DIG. 38; 366/154, 155.1, 155.2, 156.1, 156.2; 414/412

[56] References Cited

U.S. PATENT DOCUMENTS

| | | | |
|---|---|---|---|
| 3,802,631 | 4/1974 | Boyd | 241/24 X |
| 3,834,630 | 9/1974 | Nelson | 241/24 X |
| 4,070,202 | 1/1978 | Nollet | 241/24 X |
| 5,100,240 | 3/1992 | D'Alterio | 366/156.1 X |
| 5,104,047 | 4/1992 | Simmons | 241/24 X |
| 5,165,612 | 11/1992 | Brown | 241/101.8 |
| 5,297,742 | 3/1994 | Grunditz et al. | 241/24 X |

FOREIGN PATENT DOCUMENTS

| | | |
|---|---|---|
| 0032783A1 | 6/1981 | European Pat. Off. . |
| 955570 | 10/1962 | United Kingdom . |
| 2073603 | 4/1981 | United Kingdom . |
| 2168261 | 12/1984 | United Kingdom . |

*Primary Examiner*—Timothy V. Eley
*Attorney, Agent, or Firm*—Susan L. Parulski

[57] ABSTRACT

A method of mixing two or more materials, at least one of which is supplied in packaged form comprises the steps of passing the packaged material to a processing unit while still in its packaging and then breaking open the packaging in the processing unit so that the material can escape therefrom. The materials can then be mixed in a mixing apparatus, with the broken down packaging subsequently being filtered from the mixed materials. In this way the material which is supplied in packaged form need not be handled directly. The filtered out packaging may be washed prior to disposal or recycling.

8 Claims, 1 Drawing Sheet

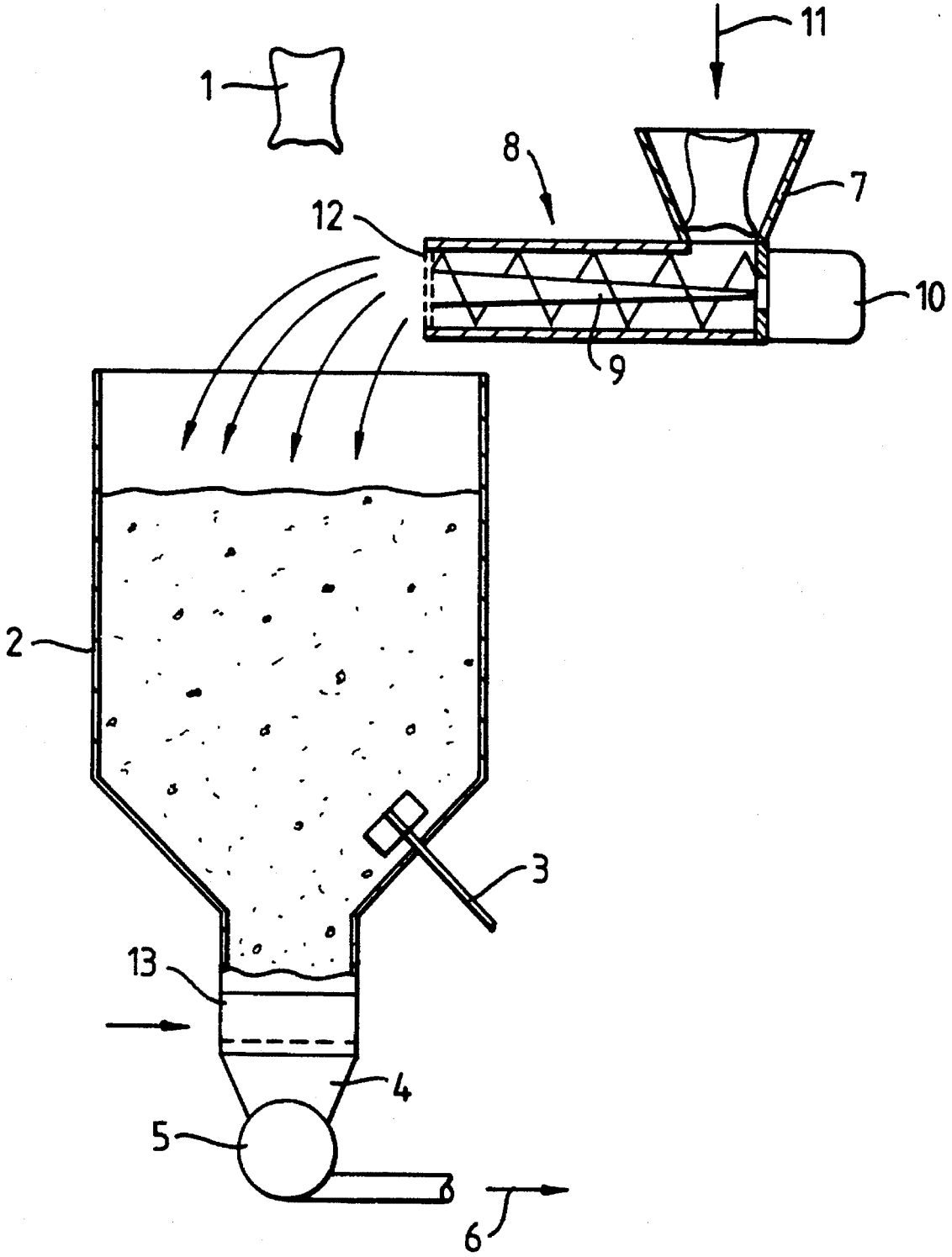
1
11
8
7
12
10
9
2
3
13
4
5
6

MIXING METHOD FOR MATERIAL ONE OF WHICH IS IN PACKAGED FORM

FIELD OF THE INVENTION

This invention relates to a method of and apparatus for mixing two or more materials. The invention is particularly concerned with the mixing of materials, at least one of which may be awkward or hazardous to handle.

BACKGROUND OF THE INVENTION

It is known, for example, to supply chemicals as concentrates in powder form where the concentrate is mixed with water in order to produce a chemical of the required strength. The chemical concentrate may be hazardous to handle. The concentrate will normally be packaged in some form of container and the careful opening of the container may prove awkward or difficult. Furthermore emptying the chemical powder from the container can produce a significant amount of dust which may create a hazardous working environment. From an environmental point of view it is usually desirable, and in some cases essential, that the containers in which the chemicals are supplied be washed or otherwise treated in order to remove most, if not all, traces of the chemical from the container before it is disposed of or recycled.

SUMMARY OF THE INVENTION

The present invention seeks to provide a method of, and apparatus for, mixing materials which addresses the concerns outlined above.

One aspect of this invention provides a method of mixing two or more materials, at least one of which is supplied in packaged form, the method comprising the steps of passing the packaged material to a processing unit associated with a mixing apparatus, the packaged material being passed to the processing unit while still packaged, breaking open the packaging in the processing unit so that material can escape therefrom, passing the two or more materials to the mixing apparatus, mixing the materials in the mixing apparatus and filtering the materials to remove the broken packaging therefrom.

Preferably the packaging is cut up in the processing unit after having been broken open.

Conveniently the broken packaging is subjected to a washing process after having been filtered from the materials.

Advantageously the broken packaging is washed using a liquid which constitutes one of the materials to be mixed.

Preferably the broken packaging is present in the materials during mixing and, after mixing, the mixed materials are removed from the mixing apparatus, the broken packaging being filtered from the mixed materials as they are removed from the mixing apparatus, the filtered out packaging being washed after the mixed materials have been removed from the mixing apparatus, and being removed from the mixing apparatus after the washing process.

Conveniently one of the materials is in liquid form and one of the materials is in powder or granular form, the liquid and the powder or granules both being passed to the processing unit substantially simultaneously.

The materials to be mixed may comprise the components of a developer or fixer used in a photographic processing device.

Another aspect of this invention provides an apparatus for mixing two or more materials, at least one of which is supplied in packaged form, the apparatus comprising a processing unit adapted to receive the packaged material while still in its packaging, means within the processing unit for breaking open the packaging so that material can escape therefrom, apparatus for mixing the materials and means for filtering the material to remove the broken packaging therefrom.

The processing unit may comprise a conveyor for conveying the materials to the mixing apparatus, the conveyor being separate from the mixing apparatus.

Preferably the processing unit incorporates means for cutting up the packaging once it has been broken open.

Conveniently the filtering means form part of the mixing apparatus.

Advantageously the mixing apparatus forms part of a photographic processing device.

BRIEF DESCRIPTION OF THE DRAWINGS

In order that the present invention may be more readily understood and so that further features thereof may be appreciated, the invention will now be described by way of example, with reference to the accompanying drawing which is a schematic illustration of apparatus used for mixing materials in accordance with the method of this invention.

DETAILED DESCRIPTION OF THE INVENTION

Referring to the accompanying drawing a chemical concentrate in powder form is supplied in sealed plastic bags or sacks 1. The chemical concentrate has to be mixed with water to produce a chemical of the correct working strength. The powder concentrate is therefore supplied, together with water, to a mixing vessel 2 which has a paddle or stirrer 3. The powder concentrate and the water are mixed in the mixing vessel 2 for the required length of time to produce a substantially homogenous chemical of the required strength. The mixing vessel has an outlet 4 at its lower end through which the chemical is removed by means of a pump 5 which then conveys the chemical to a holding tank or to a location where it is to be used, as indicated by the arrow carrying reference numeral 6.

As described thus far the method of mixing the chemical concentrate with water to produce the desired working strength is conventional.

With the method of the present invention however, the powder concentrate is supplied to the mixing vessel 2 without the need to handle the powder itself. Thus, the plastic sacks 1 containing the powder concentrate are introduced into a throat, hopper or the like 7 which forms the inlet of a screw-type conveyor 8 incorporating a worm 9. The worm 9 is mounted within the conveyor for rotation by means of a motor 10 disposed at one end of the conveyor.

At the same time as the powder concentrate is introduced into the conveyor in its sealed packaging, water is also supplied to the conveyor as illustrated by the arrow carrying reference numeral 11.

Upon rotation of the worm 9 the powder/water mixture is compressed and forced along a narrowing passageway within the conveyor towards an outlet 12 located at the left hand end of the conveyor as seen in the drawing. The outlet 12 is provided with a set of cutting blades.

When the sealed sacks of powder concentrate pass into the screw conveyor the worm 9 causes them to burst or otherwise break open so that the powder concentrate escapes therefrom and starts to mix with the water which is present in the conveyor. The presence of water within the conveyor acts to prevent any significant amount of dust from being generated and escaping into the atmosphere as the sacks are burst or otherwise broken open and the powder concentrate escapes therefrom. As the material within the conveyor is passed through the outlet 12, the blades which are located at the outlet cut the broken sacks into relatively small pieces which then pass into the mixing vessel 2 together with the powder/water mixture. The screw conveyor merely represents one convenient form of a "processing unit" for opening the sealed packaging within which the chemical concentrate is supplied and for feeding the concentrate and the water to the mixing vessel 2. This "processing unit" could take other forms and could form an integral part of the mixing apparatus.

As mentioned above the powder and water are mixed in the mixing vessel 2 for the necessary period of time to produce a substantially homogenous chemical of the required working strength. The broken down packaging is still present within the chemical in the mixing vessel 2 during the mixing process.

The chemical, including pieces of packaging, is drawn towards the outlet 4 of the mixing vessel by the pump 5. A filter 13 is positioned adjacent the outlet 4 and as the material moves towards the outlet 4 of the mixing vessel it passes through the filter which traps the pieces of plastic which formed the packaging for the powder concentrate while permitting the chemical which is now in a liquid, flowable form, to pass into the pump 5.

When the mixing vessel has been emptied the unwanted pieces of packaging which have been trapped by the filter 13 may be washed. This is effected by providing a further supply of water only to the system either via the screw conveyor 8 or directly into the mixing vessel 2. This water passes over the pieces of packaging trapped on the filter 13 and washes any remaining traces of the powder concentrate therefrom. The filter 13 which may be a cartridge-type filter, is removed from the mixing vessel 2 and the unwanted remnants of packaging, which are now clean and safe to handle, can be disposed of or recycled. The filter is then replaced ready for the next batch to be made up. The water which is used to wash the remnants of packaging on the filter 13 can be pumped to a holding tank and used as part of the mix for the next batch, thereby avoiding any waste.

It is envisaged that this invention will be used in the supply of chemicals to an apparatus for the processing of photographic material. Thus, the chemical may, for example, be one component of a developer or fixer used in the processing of photographic material. However, the invention is by no means limited to this particular application and may have many other applications where the general mixing or blending of materials (not necessarily chemical concentrates) is required and where one may not wish directly to handle the material. By way of example one may consider the blending or mixing of animal foodstuffs, either in liquid or solid form, or the mixing of pesticides and the like which are supplied in powder or granular form with a liquid so that they may be applied by spraying.

While the specific arrangement which has been described and illustrated involves the mixing of a material in powder form with a liquid, the invention could be used in order to mix materials in various forms. Thus two liquids, at least one of which is packaged, could be mixed, as could two materials in powder or granular form where again at least one of the materials is supplied in a sealed package.

Furthermore, while in the specific arrangement described the powder concentrate is sealed in a plastic sack, the apparatus of the invention could readily be adapted to cope with other types of packaging. Thus it is envisaged that the screw conveyor 8 could be adapted to handle materials which are sealed within semi-rigid containers such as cardboard cartons, drums or the like. Indeed the invention could be put into practice with materials which are packaged in any type of container which may be broken open by appropriate processing apparatus.

While only one material is packaged in the example described, it would, of course, be possible for all of the materials to be supplied in packaged form. The invention is not restricted to the mixing of two materials and could be used in order to mix three or more materials.

It will be appreciated that the mixing method reduces operator handling of the materials to a minimum and may, in some cases, avoid any need for the materials to be handled directly. The apparatus of the invention could be fully shrouded, with the exception of the inlet 7 to the conveyor, so that once packaged materials have been introduced into the conveyor there is no further contact with the material whatsoever. The waste packaging removed from the filter 13 is, as a result of the washing process referred to above, clean and safe to handle thereby eliminating any concerns about operator hygiene. Reusing the water with which the remnants of packaging have been washed and possibly recycling the packaging helps in the preservation of natural resources and addresses environmental concerns over waste material.

Where the invention is used for the mixing of chemical concentrates used in the processing of photographic materials, the screws conveyor 8 may be fitted to existing apparatus including the mixing vessel 2. Thus, the implementation of the invention in this field would require only the minimum of modifications to existing apparatus. While the conveyor 8 has been schematically illustrated as being separate from the mixing vessel, it could form an integral part of a mixing apparatus.

It is to be appreciated that various modifications may be made to the specific arrangement described and illustrated without departing from the scope of this invention, as defined by the appendant claims.

I claim:

1. A method of mixing two or more materials, at least one of which is supplied in packaged form, the method comprising the steps of:

passing the packaged material in its packaged form to a processing unit associated with a mixing apparatus;

breaking open the packaged material in the processing unit so that material can escape therefrom;

mixing the materials in the mixing apparatus;

filtering the materials to remove the broken packaging therefrom as the mixed materials are removed from the mixing apparatus;

washing the broken packaging after removing the mixed materials from the mixing apparatus; and removing the broken packaging from the mixing apparatus alter washing the broken packaging.

2. A method according to claim 1 wherein the packaging is cut up in the processing unit after having been broken open.

3. A method according to claim 2 wherein the broken packaging is washed using a liquid which constitutes one of the materials to be mixed.

4. A method according to claim 1 wherein one of the materials is in liquid form and one of the materials is in powder or granular form, the liquid and the powder or granules both being passed to the processing unit substantially simultaneously.

5. A method according to claim 4 wherein the materials to be mixed comprise the components of a developer or fixer used in a photographic processing device.

6. A method of mixing two or more materials, at least one of which is supplied in packaged form, the method comprising the steps of:

passing the packaged material in its packaged form to a processing unit associated with a mixing apparatus;

breaking open the packaged material in the processing unit so that material can escape therefrom;

cutting up the packaging in the pressing unit after having been broken open:

mixing the materials in the mixing apparatus, the broken packaging being present during mixing;

filtering the materials to remove the broken packaging therefrom as the mixed materials are removed from the mixing apparatus;

washing the broken packaging using a liquid which constitutes one of the materials to be mixed after filtering the materials and removing the mixed materials from the mixing apparatus; and removing the broken packaging from the mixing apparatus after the washing of the broken packaging.

7. A method according to claim 6 wherein one of the materials is in liquid form and one of the materials is in powder or granular form, the liquid and the powder or granules both being passed to the processing unit substantially simultaneously.

8. A method according to claim 7 wherein the materials to be mixed comprise the components of a developer or fixer used in a photographic processing device.

* * * * *

UNITED STATES PATENT AND TRADEMARK OFFICE

CERTIFICATE OF CORRECTION

PATENT NO. : 5,507,440
DATED : April 16, 1996
INVENTOR(S) : Anthony Earle

It is certified that error appears in the above-indentified patent and that said Letters Patent is hereby corrected as shown below:

Column 4, Line 61, should read --tus after washing the broken packaging.--

Column 5, Line 16, should read --cutting up the packaging in the processing unit after having--

Signed and Sealed this

Twenty-fifth Day of June, 1996

*Attest:*

BRUCE LEHMAN

*Attesting Officer*

*Commissioner of Patents and Trademarks*